US006179720B1

(12) United States Patent
Rankin et al.

(10) Patent No.: US 6,179,720 B1
(45) Date of Patent: Jan. 30, 2001

(54) CORRELATION METHOD AND APPARATUS FOR TARGET-ORIENTED SPORTS ACTIVITIES

(75) Inventors: David Benjamin Rankin; James W. Kluttz, both of Winston-Salem, NC (US)

(73) Assignee: Accu-Sport International, Inc., Winston-Salem, NC (US)

( * ) Notice: Under 35 U.S.C. 154(b), the term of this patent shall be extended for 0 days.

(21) Appl. No.: 09/081,985

(22) Filed: May 20, 1998

Related U.S. Application Data

(60) Provisional application No. 60/047,266, filed on May 21, 1997.

(51) Int. Cl.[7] ..... A63B 69/36
(52) U.S. Cl. ..... 473/154; 473/155
(58) Field of Search ..... 473/168–170, 473/151–155

(56) References Cited

U.S. PATENT DOCUMENTS

| | | | | |
|---|---|---|---|---|
| 4,898,388 | | 2/1990 | Beard, III et al. . | |
| 4,922,222 | * | 5/1990 | Baker | 473/153 |
| 5,029,866 | | 7/1991 | Beard, III et al. . | |
| 5,303,924 | | 4/1994 | Kluttz et al. . | |
| 5,342,051 | | 8/1994 | Rankin et al. . | |
| 5,354,063 | * | 10/1994 | Curchod | 473/155 |
| 5,401,026 | * | 3/1995 | Eccher et al. | 473/155 |
| 5,413,345 | * | 5/1995 | Nauck | 473/168 |
| 5,489,099 | | 2/1996 | Rankin et al. . | |
| 5,562,285 | * | 10/1996 | Anfinsen et al. | 473/155 |

* cited by examiner

*Primary Examiner*—Mark S. Graham
(74) *Attorney, Agent, or Firm*—Alston & Bird LLP

(57) ABSTRACT

The correlation method and apparatus matches the impact location of an object at or near a predetermined target with one of many shots at the target. For example, the correlation method and apparatus can match the golf ball driven from a tee box with an impact location within the target area. The correlation method and apparatus can therefore identify which one of a number of golf balls landing within the target area was hit from a specific tee box at a golf practice range having numerous tee boxes using the same target area. The correlation apparatus includes a first sensor for determining a golf ball striking time at which the golf ball is driven from the tee box toward the target area. The correlation apparatus also includes a second sensor for determining the respective impact locations and times of a plurality of golf balls within the target area. In addition, the correlation apparatus includes a signal processor for discriminating between the plurality of golf balls which landed within the target area so as to match the respective impact location of one of the plurality of golf balls with the golf ball driven from the tee box at the golf ball striking time. Thereafter, the signal processor can determine the flight distance of the golf ball even though the golf ball was not tracked during flight.

18 Claims, 3 Drawing Sheets

CORRELATION METHOD AND APPARATUS FOR TARGET-ORIENTED SPORTS ACTIVITIES

CROSS REFERENCE TO RELATED APPLICATION

The present application is related to and claims priority from U.S. Provisional Patent application Ser. No. 60/047,266 filed May 21, 1997, the contents of which are incorporated herein in their entirety.

FIELD OF THE INVENTION

The present invention relates to a correlation method and apparatus for target-oriented sports activities and, more particularly, to a method and apparatus for matching a golf ball driven from a tee box of a practice range with an impact location within a target area of the practice range.

BACKGROUND OF THE INVENTION

Golf ranges, both outdoor and indoor, are commonplace and serve to permit a golfer to practice a variety of shots with different clubs. While practice is required if a golfer wishes to improve their game, many golfers find practice at a golf range to be quite boring, particularly in comparison to actual play. Accordingly, Accu-Sport International, Inc. of Winston-Salem, N.C. has developed an apparatus for simulating a golf game at a practice range as described by U.S. Pat. No. 5,303,924 to James W. Kluttz, et al., the contents of which are incorporated herein in their entirety.

As described by the Kluttz '924 patent, the golf game apparatus includes a display positioned adjacent to the tee box of the practice range to display a simulated golf hole layout. Following a golf shot, the golf game apparatus determines the total distance of the shot based upon the actual flight time of the golf ball, the linear flight distance of the golf ball to an initial impact position and a simulation of the anticipated roll of the golf ball following impact. As a result, the display can also provide an indication of the final resting position of the golf ball relative to the simulated golf hole layout. The golf game apparatus of the '924 patent therefore provides a golfer with a significant amount of information regarding their practice shots, including the linear flight distance and the total distance of each shot. See also U.S. Pat. No. 4,898,388 to Bryce P. Beard, III, et al. which describes a system including a number of vibration sensors for determining the impact location of a golf ball and a display for providing a golfer with a visual representation of the relative position of the impact location with respect to a predetermined target.

While the devices described by the Kluttz '924 patent and the Beard '388 patent represent great advances in the art, difficulties can arise if two or more golfers are hitting golf balls at the practice range at the same time. In these circumstances, conventional devices for determining the impact location of a golf ball will be generally unable to distinguish between the golf balls hit by each of the golfers. As a result, these conventional devices will be unable to reliably determine the impact location of a golf ball hit by any one of the golfers since the respective impact locations of the golf balls hit by the other golfers may be misinterpreted as the impact location of the golf ball hit by the golfer of interest.

The devices described by the Kluttz '924 patent and the Beard '388 patent have difficulty distinguishing between the golf balls hit by a number of golfers since these device do not track the golf balls during flight but, instead, await impact of the golf balls within the target area in order to detect the respective impact locations of the golf balls. Accordingly, tracking systems have been developed which track the golf ball during flight from the tee box to the target area. For example, Accu-Sport International, Inc. has also developed a system including a video camera and an associated video frame processor for tracking the flight of a golf ball as described by U.S. Pat. Nos. 5,342,051 and 5,489,099 to David B. Rankin, et al., the contents of which are incorporated herein in their entirety. While tracking systems can accurately determine the flight path and resulting impact location of a golf ball hit by one of many golfers at a practice range, tracking systems can only monitor one golfer at a time. As a result, a practice range having a number of tee boxes or hitting bays would have to purchase several tracking systems in order to track the golf balls hit by golfers from different ones of the tee boxes, thereby significantly increasing the cost to the practice range in comparison to non-tracking systems.

SUMMARY OF THE INVENTION

The correlation method and apparatus of the present invention matches the impact location of an object at or near a predetermined target with one of many shots at the target. For example, the correlation method and apparatus can match the golf ball driven from a tee box with an impact location within the target area. Advantageously, the method and apparatus of the present invention can identify which one of a number of golf balls landing within the target area was hit from a specific tee box at a golf practice range having numerous tee boxes using the same target area. Thus, the method and apparatus of the present invention can determine the flight distance and flight time of the golf ball in a reliable manner without tracking the golf ball during flight.

The apparatus of the present invention includes first sensor means for determining a golf ball striking time at which the golf ball is driven from the tee box toward the target area. The first sensor means also preferably determines an initial velocity and a launch angle of the golf ball such that a predicted range of the golf ball can be determined. The apparatus also includes second sensor means for determining the respective impact locations of a plurality of golf balls within the target area. Preferably, the second sensor means determines respective golf ball impact times for each of the plurality of golf ball landing within the target area. The second sensor means then generates signals representative of the respective impact locations of the plurality of golf balls.

The apparatus of the present invention also includes a signal processing means, such as a signal processor, responsive to data provided by the first and second sensor means. The signal processor discriminates between the plurality of golf balls which landed within the target area so as to match the respective impact location of one of the plurality of golf balls which landed within the target area with the golf ball driven from the tee box at the golf ball striking time. Once the impact location of the golf ball is determined, the flight distance of the golf ball can be readily determined even though the golf ball was not tracked during its flight.

In embodiments in which the predicted range of a golf ball is determined based upon the initial velocity and the launch angle of the golf ball, the signal processor can include means for comparing the respective flight distances of the plurality of golf balls landing within the target area to the predicted range of the golf ball driven from the tee box toward the target area. The signal processor of this embodiment can also include means for identifying each of the golf balls landing within the target area which has a respective flight distance within a predetermined window, such as a predetermined percentage or a predetermined number of feet, about the predicted range as a potential match.

In embodiments in which the second sensor means determines respective golf ball impact times for the plurality of golf balls landing within the target areas, the second sensor means can include means for determining the respective flight times of the plurality of golf balls landing within the target area based upon the respective golf ball striking and golf ball impact times.

The signal processor of this embodiment can also include means for comparing the respective flight times of the plurality of golf balls landing within the target area with a predetermined flight time window and for identifying each of the golf balls landing within the target area which has a respective flight time within the predetermined flight time window as a potential match, i.e., as a candidate to be the golf ball driven from the tee box at the golf ball striking time. The signal processor of this embodiment can also include means for determining the respective ball velocities for the plurality of golf balls landing within the target area based upon the respective golf ball striking and golf ball impact time and the respective flight distances of the plurality of golf balls landing within the target area. The signal processor of this embodiment can further include means for comparing the respective ball velocities of the plurality of golf balls landing within the target area with a predetermined ball velocity and for identifying each of the golf balls landing within the target area which has a respective ball velocity within a predetermined window about the predetermined ball velocity as a potential match, i.e., as a candidate to be the golf ball driven from the tee box at the golf ball striking time.

If more than one potential match is identified by the signal processor, the apparatus of the present invention can include means for identifying one of the plurality of potential matches as the impact location of the golf ball driven from the tee box toward the target area at the golf ball striking time. Typically, the apparatus of this embodiment identifies one of the plurality of potential matches as the impact location of the golf ball driven from the tee box at the golf ball striking time by identifying the golf ball having the flight distance, flight time and ball velocity which most nearly equals the predicted range, the average of the predetermined flight time window and the predetermined ball velocity, respectively.

Therefore, the correlation method and apparatus of the present invention can match the impact location of an object at or near a predetermined target with one of many shots at the target. For example, the method and apparatus of the present invention can reliably correlate the impact locations of the golf balls landing within the same target area with respective golf balls driven from one or more tee boxes at a golf practice range. Thus, the method and apparatus of the present invention can determine the flight distance and flight time for each of the golf shots for subsequent display to the golfer. A golfer can therefore obtain accurate data relating to their golf shots in a real time or near real time fashion such that the golfer can make appropriate adjustments, if necessary, to their swing in order to improve their golf shot.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiments set forth herein; rather, this embodiment is provided so that this disclosure will be thorough and complete and will fully convey the scope of the invention to those skilled in the art. Like numbers refer to like elements throughout.

The correlation method and apparatus of the present invention matches a golf ball driven from a tee box with an impact location within a target area as described in detail below. However, the correlation method and apparatus of the present invention can be employed in conjunction with a variety of different target-oriented sports activities in order to match the impact location of an object at or near a predetermined target with one of many shots at the target. For example, the correlation method and apparatus of the present invention can be employed in conjunction with target shooting, darts, archery or the like in order to match the impact location of an object at or near a predetermined target with one of many shots at the target. For purposes of illustration, however, the correlation method and apparatus of the present invention will be described hereinafter in conjunction with a golf shot.

Figure 1:
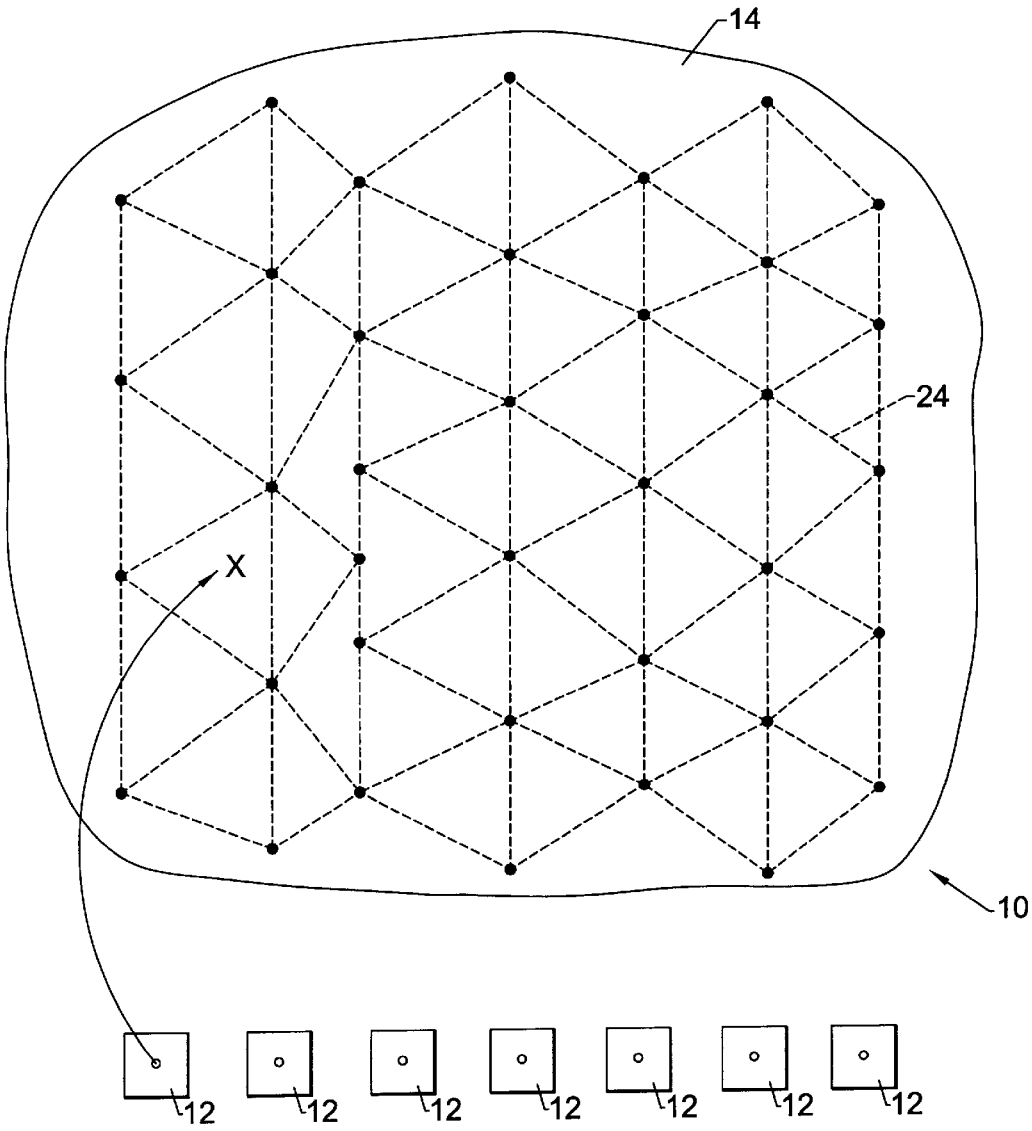
FIG. 1 is a plan view of a practice range having a plurality of tee boxes and a predetermined target area.

As shown in FIG. 1, a practice range 10 is shown which includes a number of tee boxes 12 and a common target or landing area 14 for each of the tee boxes. As shown by the looping arrow in FIG. 1, a golfer will drive the golf ball from an initial position, typically at a respective one of the tee boxes, to a final position. The final position of the golf ball is determined in large part by the impact location of the golf ball, that is, the first location at which the golf ball strikes the ground (designated by an "X" in FIG. 1). In addition, the impact location of a golf ball also determines several important parameters of a golf shot, namely, the flight time and the flight distance of the golf ball.

Figure 2:
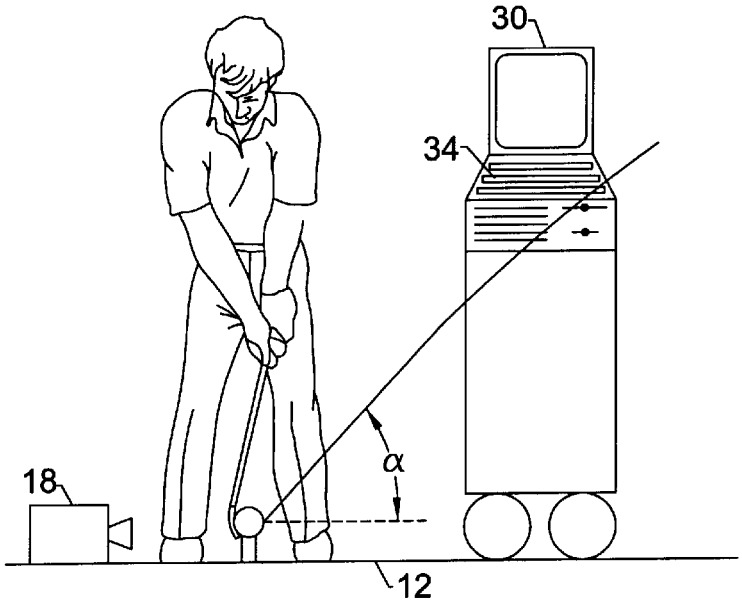
FIG. 2 is an elevational view of one of the tee boxes of FIG. 1 which illustrates a display for providing information to the golfer and a tee monitor for determining the golf ball striking time, the initial velocity of the golf ball and the launch angle of the golf ball.
Figure 3:
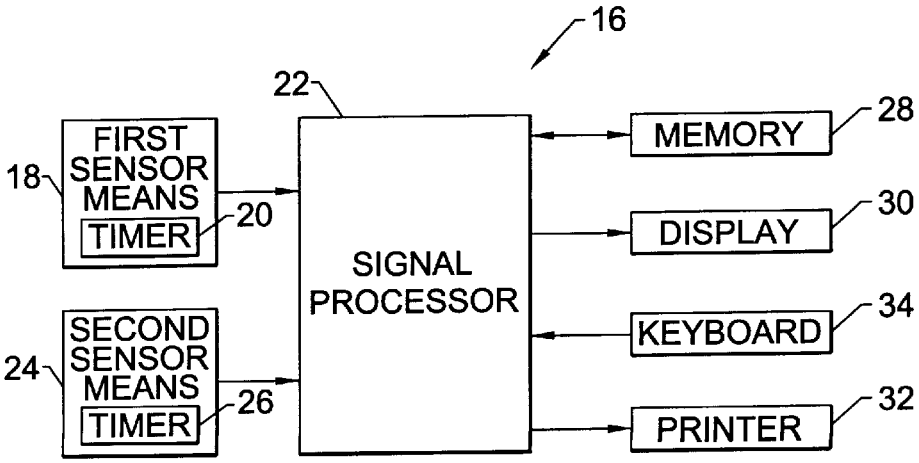
FIG. 3 is a block diagram of an apparatus for matching a golf ball driven from the tee box with an impact location within the target area according to one embodiment of the present invention.
Figure 4:
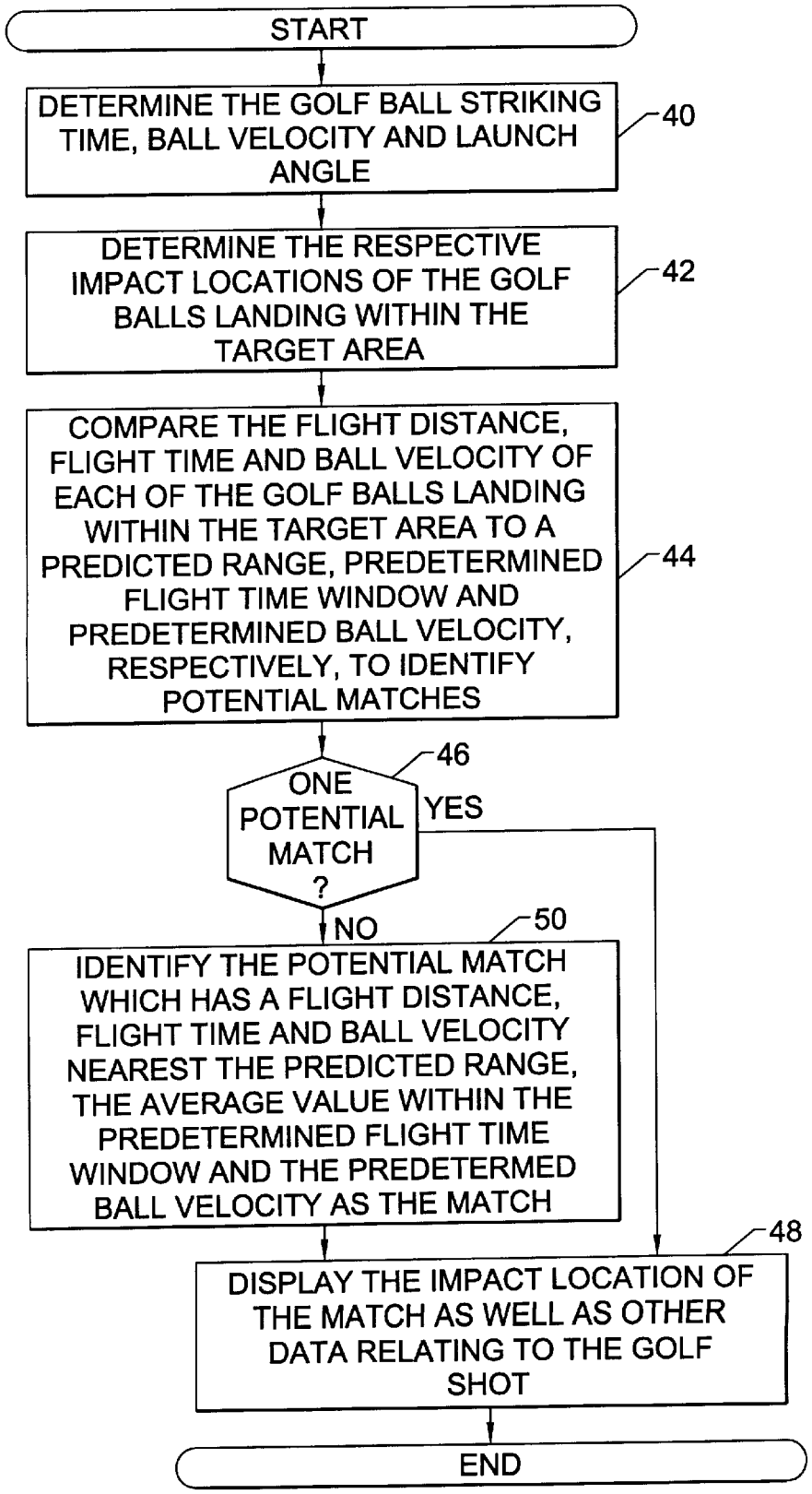
FIG. 4 is a flowchart illustrating the operations performed by one embodiment of the method and apparatus of the present invention.

As shown in FIGS. 2 and 3, the apparatus 16 of the present invention includes first sensor means 18, such as a first sensor, for detecting a golf shot in which the golf ball is driven from a first tee box 12 toward the target area 14. The first sensor means can include a variety of devices including a tee monitor available from Distance Caddy Company, 3555 Stanford Road, Suite 207, Ft. Collins, Col. 80525. As known to those skilled in the art, a tee monitor includes a radar-based measurement device for detecting movement of a golf ball, such as upon driving the golf ball from the tee box toward the target area. As shown in FIG. 3, the first sensor means preferably includes a timer 20 for determining the golf ball striking time at which the golf ball is driven from the tee box toward the target area. In addition, the first sensor means preferably determines the initial velocity and the launch angle a of the golf ball. See block 40 of FIG. 4. Based upon the initial velocity and the launch angle of the golf ball, the first sensor means can determine a predicted range for the golf ball. That is, the first sensor means can estimate the flight distance of the golf ball based upon the initial velocity and launch angle of the golf ball. Alternatively, the first sensor means can provide data relating to the initial velocity and the launch angle of the golf ball to the apparatus of the present invention for determination of the predicted range of the golf ball by the signal processor 22 or the like.

The apparatus 16 of the present invention also includes second sensor means 24, such as a second sensor, for determining the respective impact locations of the golf balls landing within the target area 14. See block 42 of FIG. 4. As shown in FIG. 1, the golf practice range generally includes a number of tee boxes 12 or hitting bays such that several golfers can be hitting golf balls toward the same target area at any one time. In order to insure that the impact location of the golf ball driven from the first tee box having the first sensor means is detected, the second sensor means determines the respective impact locations of each of the golf balls landing within the target area.

According to one advantageous embodiment, the second sensor means 24 includes at least one detector for determining the respective impact locations of the golf balls within the target area 14. More preferably, the second sensor means includes a plurality of detectors positioned at various locations about the target area for determining the respective impact locations of the golf balls. While a variety of detectors can be employed to determine the impact location of the golf balls, the detectors of one advantageous embodiment include an array of acoustical sensors as described in the Kluttz '924 patent and, in more detail, in U.S. Pat. No. 5,029,866 to Bryce P. Beard, III. As described by the Kluttz '924 patent and as shown by dashed lines in FIG. 1, the sensors are preferably positioned about the target area in a triangular pattern in order to detect the respective impact locations of the golf balls.

Regardless of the manner in which the respective impact locations of the golf balls are detected, the second sensor means 24 generates a signal representative of the impact location of each golf ball landing within the target area 14. As shown schematically in FIG. 3, the second sensor means also preferably includes a timer 26 or other means for determining the golf ball impact time for each of the golf balls landing within the target area.

The apparatus 16 of the present invention also includes a signal processing means, such as a signal processor 22, responsive to the first and second sensor means, for discriminating between the plurality of golf balls landing within the target area so as to match the respective impact location of one of a plurality of golf balls landing within the target area 14 with the golf ball driven from the first tee box 12 at the golf ball striking time. As a result, the signal processor can determine the flight distance and the flight time of the golf ball without having to track the golf ball during flight. The method and apparatus of the present invention can therefore reliably match the impact locations of a plurality of golf balls landing within the target area with golf balls driven from a number of the tee boxes without requiring the golf practice range 10 to install a separate tracking system for each tee box. The signal processor is typically comprised of a combination of software and hardware, such as a controller or microprocessor operating under software control, for processing the data provided by the first and second sensor means as described below. The apparatus also preferably includes a memory device 28 associated with the signal processor for storing the data provided by the first and second sensor means as well as data or other information generated by the signal processor.

According to one advantageous embodiment, the signal processor 22 matches the respective impact location of one of the plurality of golf balls landing within the target area 14 with the golf ball driven from the first tee box 12 at the golf ball striking time by comparing the flight distance, flight time and ball velocity of each of the golf balls landing within the target area to the predicted range, a predetermined flight time window and a predetermined ball velocity, respectively. See block 44 of FIG. 4.

In particular, the signal processor 22 of this embodiment can include means for comparing the respective flight distances of each of the golf balls landing within the target area 14 with the predicted range of the golf ball driven from the first tee box 12 toward the target area. In addition, the signal processor can include means for identifying each of the golf balls landing within the target area which has a respective flight distance within a predetermined window about the predicted range of the golf ball driven from the first tee box toward the target area as a potential match, i.e., as a candidate to be the golf ball driven from the first tee box. Typically, the predetermined window about the predicted range of the golf ball has a lower limit equal to the predicted range minus a predetermined percentage, such as 5%, and an upper limit equal to the predicted range plus the predetermined percentage. Alternatively, the predetermined window about the predicted range of the golf ball can have a lower limit defined by the predicted range minus a predetermined distance, such as twenty feet, and an upper limit defined by the predicted range plus the predetermined distance. Thus, if the flight distance of a golf ball landing within the target area is within the predetermined window about the predicted range, the signal processor of this embodiment will identify the golf ball as a potential match.

The signal processor 22 can also include means for determining respective flight times for the plurality of golf balls landing within the target area 14 based upon the respective golf ball striking and golf ball impact times determined by the first and second sensor means, respectively. The signal processor of this embodiment also includes means for comparing the respective flight times of the plurality of golf balls landing within the target area with a predetermined flight time window. The predetermined flight time window is preferably selected to include the vast majority of golf shots which could have been hit from the first tee box 12 at the golf ball striking time. In one advantageous embodiment, the predetermined flight time window has a lower limit of three seconds and an upper limit of ten seconds since almost all golf shots have been found to have a flight time of more than three seconds and less than ten seconds. The signal processor of this embodiment also includes means for identifying each of the golf balls landing within the target area which has a respective flight time within the predetermined flight time window as a potential match.

Further, the signal processor 22 can include means for determining respective ball velocities for the plurality of golf balls landing within the target area 14. The respective ball velocities are based upon the respective golf ball striking and golf ball impact times as determined by the first and second sensor means, respectively, and the respective flight distances of the plurality of golf balls. In particular, the signal processor generally divides the flight distance of a respective golf ball by the difference between the golf ball impact time and the golf ball striking time in order to determine the ball velocity of a respective golf ball. The signal processor of this embodiment also includes means for comparing the respective ball velocities of the plurality of golf balls landing within the target area with a predetermined ball velocity. According to one advantageous embodiment, a predetermined window is also defined about the predetermined ball velocity. For example, the window about a predetermined ball velocity of 16 yards per second can range from 7 yards per second to 25 yards per second so as to include the vast majority of golf shots which could have been hit from the first tee box 12. The signal processor of this embodiment also preferably includes means for identifying each of the golf balls landing within the target area which has a respective ball velocity within the predetermined window about the predetermined ball velocity as a potential match, i.e., as a candidate to be the golf ball driven from the first tee box and the golf ball striking time.

Of the potential matches, the signal processor 22 then identifies each of the plurality of golf balls landing within the target area 14 which meets each of the three criteria. That is, the signal processor determines each of the plurality of golf balls landing within the target area which has a flight distance within a predetermined window about the predicted range of the golf ball, a flight time within a predetermined flight time window, and a ball velocity within a predetermined window about the predetermined ball velocity. Typically, the signal processor will identify only one golf ball landing within the target area which meets each of the three criteria. In this instance, the method and apparatus 16 of the present invention will identify this golf ball as the golf ball which was driven toward the target area from the first tee box 12 at the golf ball striking time. See block 46 of FIG. 4.

Based upon the impact location of this golf ball, the method and apparatus 16 of the present invention can determine a significant amount of useful information relating to the golf shot, such as the flight distance of the golf ball, the flight time of the golf ball, the ball velocity, and the angular deviation to the left or right relative to the tee box 12. In addition to storing the data generated by the signal processor 22, such as with the memory device 28 for subsequent analysis, the apparatus of the present invention can include a display 30 located at or near the tee box for displaying the information relating to the golf shot for review and analysis by the golfer in real time or near real time. See block 48 of FIG. 4. As such, the golfer can modify their golf swing in an attempt to cure any perceived deficiency with the preceding golf shot. The apparatus can also include a printer 32 for printing a hard copy of the displayed and/or stored information.

If, however, the signal processor 22 identifies two or more golf balls which meet each of the three criteria, namely, flight distance, flight time and ball velocity, the method and apparatus 16 of the present invention can preferably identify one of these potential matches or candidates as the golf ball which was driven from the first tee box 12 toward the target area 14 at the golf ball striking time. For example, the apparatus can display the relative impact locations of each of the potential matches for review by the golfer. The golfer can then provide an input signal, such as by depressing one or more keys on a keypad 34 associated with the display 30, for indicating which one of the potential matches represents the impact location of the golfer's most recent golf shot. Based on the input from the golfer, the method and apparatus of the present invention will then match the selected impact location with the golf ball which was driven from the first tee box toward the target area at the golf ball striking time.

Alternatively, the apparatus 16 of the present invention and, more particularly, the signal processor 22, can determine which one of the potential matches has a flight distance, flight time and ball velocity nearest to the predicted range, the average flight time within the predetermined flight time window and the predetermined ball velocity, respectively. The golf ball which is identified by the signal processor as having a flight distance, flight time and ball velocity nearest to the predicted range, the average flight time within the predetermined flight time window and the predetermined ball velocity, respectively, will then be identified as the golf ball which was driven from the first tee box 12 toward the target area 14 at the golf ball striking time. See block 50 of FIG. 4.

In some instances, the signal processor 22 of this embodiment may not be able to identify a single golf ball as having a flight distance, flight time and ball velocity nearest to the predicted range, the average flight time within the predetermined flight time window and the predetermined ball velocity, respectively. Instead, the signal processor may identify two or more golf balls as being potential matches or candidates to be the golf ball driven from the first tee box at the golf ball striking time.

For example, first and second golf balls may be driven toward the same target area 14 from first and second tee boxes, respectively, at approximately the same time. For each respective impact location, the signal processor 22 will individually determine the flight distance, flight time and ball velocity of the first and second golf balls to the respective impact location. Ideally, one of the golf balls will match one of the impact locations, while the other golf ball will match the other impact location. Sometimes, however, both golf balls may appear to more closely match the same impact location and neither of the golf balls may appear to match the other impact location. In this instance, the apparatus 16 can display the relative impact locations of each of the golf balls for review by the golfers at the first and second tee boxes, as described above. The golfers can then provide an respective input signal that indicates which one of the impact locations is the impact location of the golfer's most recent golf shot. Based on the input from the golfers, the method and apparatus of the present invention will then match the selected impact locations with the golf balls which were driven from the first and second tee boxes toward the target area at approximately the same time.

By matching the impact location of one of the golf balls landing within the target area 14 with the golf ball driven from the first tee box 12 at the golf ball striking time, the method and apparatus 16 of the present invention can reliably determine the flight distance and flight time of a golf ball hit from a specific tee box at a golf practice range 10 having numerous tee boxes using the same target area without tracking the golf ball during flight. As a result, the cost of the overall system is reduced in comparison to the multiple tracking systems which would have to be purchased by a golf practice range in order to simultaneously track golf balls hit by several golfers from different ones of the tee boxes. Based upon the reliable matching of an impact location of a golf ball landing within the target area to the golf ball driven from the first tee box, the method and apparatus of the present invention can also provide data relating to the golf shot in a real time or near real time fashion to the golfer such that the golfer can make appropriate adjustments, if necessary, to their swing in order to improve their golf shot.

In the drawings and the specification, there has been set forth a preferred embodiment of the invention and, although specific terms are employed, the terms are used in a generic and descriptive sense only and not for purpose of limitation, the scope of the invention being set forth in the following claims.

That which is claimed is:

1. An apparatus for use at a golf practice range having a tee box and a target area for matching a golf ball driven from the tee box with an impact location within the target area, the apparatus comprising:

first sensor means for determining a golf ball striking time at which the golf ball is driven from the tee box toward the target area, wherein said first sensor means also determines an initial velocity and a launch angle of the golf ball driven from the tee box toward the target area such that a predicted range of the golf ball can be determined;

second sensor means for determining the respective impact locations of a plurality of golf balls within the target area and for generating signals representative of the respective impact locations of the plurality of golf balls; and signal processing means, responsive to said first and second sensor means, for matching the respective impact location of one of the plurality of golf balls landing within the target area with the golf ball driven from the tee box at the golf ball striking time such that the flight distance of the golf ball can be determined without tracking the golf ball during flight.

2. An apparatus according to claim 1 wherein said signal processing means comprises:

means for comparing the respective flight distances of the plurality of golf balls landing within the target area with the predicted range of the golf ball driven from the tee box toward the target area; and means, responsive to said comparing means, for identifying each of the plurality of golf balls landing within the target area which has a respective flight distance within a predetermined window about the predicted range of the golf ball driven from the tee box toward the target area as a potential match.

3. An apparatus according to claim 1 wherein said second sensor means determines respective golf ball impact times for the plurality of golf balls landing within the target area.

4. An apparatus according to claim 1 wherein said signal processing means comprises:

means for determining respective flight times of the plurality of golf balls landing within the target area based upon the respective golf ball striking and golf ball impact times;

means, responsive to said flight time determining means, for comparing the respective flight times of the plurality of golf balls landing within the target area with a predetermined flight time window; and means, responsive to said comparing means, for identifying each of the plurality of golf balls landing within the target area which has a respective flight time within the predetermined flight time window as a potential match.

5. An apparatus according to claim 1 wherein said signal processing means comprises:

means for determining respective ball velocities for the plurality of golf balls landing within the target area based upon the respective golf ball striking and golf ball impact times and the respective flight distances of the plurality of golf balls landing within the target area;

means, responsive to said ball velocity determining means, for comparing the respective ball velocities of the plurality of golf balls landing within the target area with a predetermined ball velocity; and.

means, responsive to said comparing means, for identifying each of the plurality of golf balls landing within the target area which has a respective ball velocity within a predetermined window about the predetermined ball velocity as a potential match.

6. An apparatus according to claim 1 wherein said signal processing means comprises means for identifying the respective impact locations of a plurality of the golf balls landing within the target area as potential matches, and wherein the apparatus further comprises means, responsive to said signal processor, for identifying one of the plurality of potential matches as the impact location of the golf ball driven from the tee box toward the target area at the golf ball striking time.

7. An apparatus for use at a golf practice range having a tee box and a target area for matching a golf ball driven from the tee box with an impact location within the target area, the apparatus comprising:

a first sensor for determining a golf ball striking time at which the golf ball is driven from the tee box toward the target area, wherein said first sensor also determines an initial velocity and a launch angle of the golf ball driven from the tee box toward the target area such that a predicted range of the golf ball can be determined;

a second sensor for determining the respective impact locations of a plurality of golf balls within the target area and for generating signals representative of the respective impact locations of the plurality of golf balls; and a signal processor, responsive to said first and second sensors, for discriminating between the plurality of golf balls landing within the target area such that the flight distance of the golf ball driven from the tee box at the golf ball striking time can be determined without tracking the golf ball during flight.

8. An apparatus according to claim 7 wherein said signal processor comprises:

means for comparing the respective flight distances of the plurality of golf balls landing within the target area with the predicted range of the golf ball driven from the tee box toward the target area; and means, responsive to said comparing means, for identifying each of the plurality of golf balls landing within the target area which has a respective flight distance within a predetermined window about the predicted range of the golf ball driven from the tee box toward the target area as a potential match.

9. An apparatus according to claim 7 wherein said second sensor determines respective golf ball impact times for the plurality of golf balls landing within the target area.

10. An apparatus according to claim 7 wherein said signal processor comprises:

means for determining respective flight times of the plurality of golf balls landing within the target area based upon the respective golf ball striking and golf ball impact times;

means, responsive to said flight time determining means, for comparing the respective flight times of the plurality of golf balls landing within the target area with a predetermined flight time window; and means, responsive to said comparing means, for identifying each of the plurality of golf balls landing within the target area which has a respective flight time within the predetermined flight time window as a candidate to be the golf ball driven from the tee box at the golf ball striking time.

11. An apparatus according to claim 7 wherein said signal processor comprises:

means for determining respective ball velocities for the plurality of golf balls landing within the target area based upon the respective golf ball striking and golf ball impact times and the respective flight distances of the plurality of golf balls landing within the target area;

means, responsive to said ball velocity determining means, for comparing the respective ball velocities of the plurality of golf balls landing within the target area with a predetermined ball velocity; and means, responsive to said comparing means, for identifying each of the plurality of golf balls landing within the target area which has a respective ball velocity within a predetermined window about the predetermined ball velocity as a candidate to be the golf ball driven from the tee box at the golf ball striking time.

12. An apparatus according to claim 7 wherein said signal processor comprises means for identifying the respective impact locations of a plurality of the golf balls landing within the target area as candidates to be the golf ball driven from the tee box at the golf ball striking time, and wherein the apparatus further comprises means, responsive to said signal processor, for identifying one of the plurality of candidates as the impact location of the golf ball driven from the tee box toward the target area at the golf ball striking time.

13. A method for matching a golf ball driven from a tee box of a golf practice range with an impact location within a target area of the golf practice range, the method comprising the steps of:

determining a golf ball striking time at which the golf ball is driven from the tee box toward the target area, wherein said step of determining the golf ball striking time also comprises the steps of determining an initial velocity and a launch angle of the golf ball driven from the tee box toward the target area such that a predicted range of the golf ball can be determined;

determining the respective impact locations of a plurality of golf balls within the target area;

generating signals representative of the respective impact locations of the plurality of golf balls; and matching the respective impact location of one of the plurality of golf balls landing within the target area with the golf ball driven from the tee box at the golf ball striking time such that the flight distance of the golf ball can be determined without tracking the golf ball during flight.

14. A method according to claim 13 wherein said matching step comprises the steps of:

comparing the respective flight distances of the plurality of golf balls landing within the target area with the predicted range of the golf ball driven from the tee box toward the target area; and identifying each of the plurality of golf balls landing within the target area which has a respective flight distance within a predetermined window about the predicted range of the golf ball driven from the tee box toward the target area as a potential match.

15. A method according to claim 13 wherein said step of determining the respective impact locations comprises the step of determining respective golf ball impact times for the plurality of golf balls landing within the target area.

16. A method according to claim 13 wherein said matching step comprises the steps of:

determining respective flight times of the plurality of golf balls landing within the target area based upon the respective golf ball striking and golf ball impact times;

comparing the respective flight times of the plurality of golf balls landing within the target area with a predetermined flight time window; and identifying each of the plurality of golf balls landing within the target area which has a respective flight time within the predetermined flight time window as a potential match.

17. A method according to claim 13 wherein said matching step comprises the steps of:

determining respective ball velocities for the plurality of golf balls landing within the target area based upon the respective golf ball striking and golf ball impact times and the respective flight distances of the plurality of golf balls landing within the target area;

comparing the respective ball velocities of the plurality of golf balls landing within the target area with a predetermined ball velocity; and identifying each of the plurality of golf balls landing within the target area which has a respective ball velocity within a predetermined window about the predetermined ball velocity as a potential match.

18. A method according to claim 13 wherein said matching step comprises identifying the respective impact locations of a plurality of the golf balls landing within the target area as potential matches, and wherein the method further comprises the step of identifying one of the plurality of potential matches as the impact location of the golf ball driven from the tee box toward the target area at the golf ball striking time.

* * * * *